United States Patent [19]

Ogden

[11] Patent Number: 4,893,418

[45] Date of Patent: Jan. 16, 1990

[54] SHOE INSOLE AND METHOD OF MANUFACTURE

[75] Inventor: John M. Ogden, Cincinnati, Ohio

[73] Assignee: Ogden Inc., Cincinnati, Ohio

[21] Appl. No.: 142,474

[22] Filed: Jan. 11, 1988

[51] Int. Cl.[4] ..... A43B 13/38; A43B 13/40

[52] U.S. Cl. ..... 36/44; 36/3 B; 128/595; 428/138

[58] Field of Search ..... 36/44, 43, 3 R, 3 B; 12/146 B, 146 BR; 128/588, 595; 428/138, 137

[56] References Cited

U.S. PATENT DOCUMENTS

| | | | |
|---|---|---|---|
| 354,693 | 12/1886 | Dick | 36/3 B |
| 1,106,986 | 8/1914 | Stucki . | |
| 1,994,681 | 3/1935 | Blumenfeld | 36/3 B |
| 2,300,681 | 11/1942 | Margolin . | |
| 2,432,533 | 12/1947 | Margolin | 36/3 B |
| 2,722,063 | 11/1955 | Drefvelin | 36/3 R |
| 2,748,502 | 6/1956 | Scholl | 36/44 |
| 3,383,782 | 5/1968 | McGinnity . | |
| 3,449,844 | 6/1969 | Spence | 36/44 |
| 3,530,489 | 9/1970 | Appleton | 36/44 |
| 3,555,709 | 1/1971 | Raffaelli, Sr. | 36/44 |
| 3,724,105 | 4/1973 | Weight | 36/44 |
| 4,179,826 | 12/1979 | Davidson . | |
| 4,187,621 | 2/1980 | Cohen | 36/44 |
| 4,237,626 | 12/1980 | Brown . | |
| 4,430,811 | 2/1984 | Okada | 36/44 X |
| 4,471,538 | 9/1984 | Pomeranz et al. . | |
| 4,627,179 | 12/1986 | McElroy | 36/44 |
| 4,635,385 | 1/1987 | Ogden | 36/43 |

FOREIGN PATENT DOCUMENTS

| | | | |
|---|---|---|---|
| 1026299 | 2/1953 | France | 36/3 B |
| 69831 | 9/1958 | France | 36/3 B |
| 0501878 | 3/1939 | United Kingdom | 36/44 |
| 728075 | 4/1955 | United Kingdom | 36/44 |
| 2185213 | 7/1987 | United Kingdom | 428/138 |

OTHER PUBLICATIONS

Poron Brochure, Rogers Corporation.

*Primary Examiner*—James Kee Chi

*Attorney, Agent, or Firm*—Wood, Herron & Evans

[57] ABSTRACT

An insole for a shoe, and method of manufacture, comprises a bottom layer formed of cushioning material, and a top layer formed with apertures, which, in various methods of manufacture, is embedded into the bottom layer so that the cushioning material forming the bottom layer extends at least partially into the apertures in the top layer. The coefficient of friction of the top layer of the insole which contacts the foot of the wearer is variable and chosen to control the movement of the foot along the insole depending upon the type of activity and playing surface for which the shoe is designed.

10 Claims, 4 Drawing Sheets

SHOE INSOLE AND METHOD OF MANUFACTURE

RELATED PATENTS

This invention is related to the subject matter disclosed in U.S. Pat. No. 4,635,385, owned by the assignee of this invention.

FIELD OF THE INVENTION

This invention relates generally to insoles for shoes and the methods of their manufacture, and, more particularly, to an insole having a bottom cushioning layer and a non-absorbent, thermally non-conductive top layer formed with apertures which is at least partially embedded in the bottom layer.

BACKGROUND OF THE INVENTION

New designs of shoes, and particularly shoes for sports or other active wear, have provided improvements in the support, cushioning and stability of the shoe in an effort to reduce injuries to the feet, ankles and knees. One aspect of active wear shoe design which has been overlooked, however, is the configuration and surface characteristics of the insole of the shoe as they relate to the ability of the insole to maintain the foot and sock relatively dry and insulated from the sole of the shoe, and the extent which the foot and sock are permitted to move within the shoe.

Most insoles for active wear shoes are formed of a cushioning material such as rubber, foam or the like whose uppermost surface is covered by a sheet of cloth or leather which contacts the sock of the wearer's foot. One problem with this type of insole is that the rubber or foam absorbs moisture from the sock like a sponge and does not allow the sock to dry. The cloth or leather upper layer of some insoles are provided with tiny spaced perforations to help channel away the moisture from the sock, and to provide ventilation, but the moisture is not prevented from being absorbed by the insole and simply flows back through the perforations to the sock. Additional ventilation openings are provided in the insole and/or fabric sides of the shoe in some designs, but most of the moisture is nevertheless permitted to collect and pool in the insole which prevents the sock from drying.

Another problem with prior art insoles for active wear shoes involves a failure to control the motion of the sock and foot of the wearer along the insole. This affects both the comfort and performance of the shoe. For example, certain activities such as the play of tennis on clay courts and soccer on grass result in substantial movement of the shoe with respect to the playing surface. In these types of activities, it is desirable to limit the movement of the foot and sock with respect to the insole of the shoe for added comfort and to optimize the performance of the shoe. On the other hand, comfort and performance of the shoe dictate that the foot and sock be permitted more movement within shoes intended for use in activities such as basketball, racquetball and aerobics which are typically played on a lacquered hardwood floor wherein limited movement of the shoe relative to the playing surface is permitted.

Prior art insoles can generally be divided into two categories, both of which fail to take into account the movement of the foot and sock within the shoe and the type of surface on which the shoe is utilized. In some prior art designs, the top surface of the insole is formed of a tacky or sticky material having a high coefficient of friction compared to a coefficient of friction of the skin of the foot. Active wear shoes with this type of insole have been found to create blisters on the foot because during use the sock is held in a fixed position against the insole while the foot moves within the sock. The rubbing motion of the foot within the sock creates severe blistering and discomfort, particularly in activities such as basketball and the like played on hardwood floors which permit limited motion of the shoe therealong.

The other general category of insole designs comprises a rubber or foam bottom layer which is covered by an overlayer of cloth or leather having a relatively slippery or slick surface with a much lower coefficient of friction compared to that of the skin of the wearer's foot. Insoles of this type help avoid the blistering problem because the foot and sock move as a unit relative to the slippery top layer of the insole, instead of the foot moving within the sock. The problem with these insoles is that movement of the sock and foot of the wearer is often completely unrestricted and the toes are permitted to violently slide into the front portion of the shoe causing bruising or even fractures of the toes. In addition, undue movement of the foot and sock gives the wearer a feeling of lack of control of the shoe, particularly in activities where the shoe readily slides along the playing surface.

SUMMARY OF THE INVENTION

It is therefore among the objectives of this invention to provide an insole for active wear shoes which provides a moisture and thermal barrier between the foot and the sole of the shoe; and, which controls the movement of the foot and sock within the shoe, depending upon the type of activity and playing surface for which the shoe is designed, to provide added comfort and to enhance performance of the shoe.

These objectives are accomplished in an insole comprising a bottom layer formed of a cushioning material such as rubber or foamed plastic having an upper surface and a lower surface adapted to overlie the sole of the shoe. The insole has a top layer formed with a plurality of apertures which is at least partially embedded in the bottom layer so that a portion of the top layer extends beneath the upper surface of the bottom layer and the cushioning material forming the bottom layer at least partially enters the apertures of the top layer. The top layer is embedded at different depths within the bottom layer to vary the spacing between the upper surface of the top layer and the upper surface of the bottom layer. As the spacing therebetween increases, the insole becomes more effective in channeling away moisture from the foot and in providing a thermal barrier between the foot and sole of the shoe. In addition, the frictional characteristics of the upper surface of the top layer are variable to control the movement of the foot and sock with respect to the insole depending upon the type of activity and playing surface for which a particular type of shoe is designed.

In one presently preferred embodiment, the top layer of the insole is embedded in the bottom layer so that the upper surface of the top layer is spaced above the upper surface of the bottom layer, and the cushioning material forming the bottom layer extends only partially into the apertures formed in the top layer. A path is thus formed between the top and bottom layers to channel away moisture from the foot and sock to keep them drier.

Additionally, this space between the upper surface of the top layer and the upper surface of the bottom layer provides an insulative air gap or thermal barrier which resists the transfer or heat or cold from the sole of the shoe to the wearer's foot. The material forming the top layer is also thermally non-conductive which further enhances the insole's ability to insulate the foot and sock from the heat or cold of the surface on which the shoe is utilized.

The top layer of the insole of this invention is a non-absorbent, thermally non-conductive thermoplastic material, and preferably an ethylene-vinyl acetate copolymer sold commercially by U.S. Industrial Chemicals of Tuscola, Ill. under the registered trademark ULTRATHENE. It has been found that by varying the vinyl acetate content of the ULTRATHENE material, the coefficient of friction of the upper surface of the top layer can be varied. Depending upon the type of activity for which the shoe is designed, and the surface on which the shoe is used, top layers of the insole herein having different vinyl acetate contents are employed to vary the coefficient of friction of the upper surface of the top layer and thus obtain the desired movement of the foot and sock atop the insole for added comfort and enhanced performance of the shoe.

For example, in activities such as the play of tennis on clay courts or soccer on grass, the shoe readily slides with respect to the playing surface. In these activities, it is desirable to limit the movement of the foot and sock relative to the insole in the shoe for added comfort and to provide the player with an improved feeling of control of the shoe. Limited movement of the foot and sock relative to the insole is achieved in this invention by forming the top layer of the insole with a material such as ULTRATHENE UE 646 in which the vinyl acetate content of the material is approximately 28% by weight. The upper surface of the top layer of such material has a somewhat higher coefficient of friction than that of the skin of the foot. This limits the motion of the sock and foot relative to the insole and thus provides the desired comfort and "feel" in shoes intended for such activities.

On the other hand, activities such as basketball, racquetball, squash, aerobics exercises and the like are typically played on surfaces such as lacquered hardwood floors which permit little or no movement of the shoe with respect to such surface. In these types of activities, it is preferable to permit at least some movement of both the foot and sock relative to the insole within the shoe to avoid the formation of blisters on the foot. The foot and sock should be permitted to move as a unit relative to the insole for these types of activities, at least to a limited degree, rather than holding the sock in a fixed position atop the insole which allows the foot to move within the sock and cause blisters.

Shoes intended for playing basketball, racquetball and the like are fitted with an insole of this invention wherein the upper surface of the top layer has a coefficient of friction somewhat less than the coefficient of friction of the skin of the foot. In particular, ULTRATHENE UE 635 having a vinyl acetate content of approximately 9% has been employed in the formation of the top layer which provides a lesser coefficient of friction than that of the skin of the foot and allows the sock and foot to move together as a unit, at least to a limited extent, atop the insole.

Still other activities do not involve substantial sliding of the shoe with respect to the playing surface, or the abrupt starting and stopping movement which accompanies the play of basketball and the like on surfaces having a high coefficient of friction. For example, in activities such as hiking, climbing, walking and jogging, it is desirable to restrict the motion of the foot and sock within the shoe to some degree, but permit at least some sliding motion therebetween. For these applications, the top layer of the insole of this invention has a coefficient of friction which is approximately equal to that of the skin of the foot. In other words, the frictional engagement between the sock of the wearer and the insole is approximately equal to the frictional engagement between the sock and the foot of the wearer. This is achieved in the insole herein by forming the top layer of the insole with a material such as ULTRATHENE UE 652 having a vinyl acetate content of approximately 19% by weight, and a coefficient of friction approximating that of the skin.

In another aspect of this invention, the insoles herein are formed by a variety of manufacturing processes wherein the apertured top layer of thermoplastic material of the insole is at least partially embedded within a bottom layer of cushioning material. In one presently preferred embodiment, a cushioning material such as urethane is injected in liquid form into the female half of a mold having the shape of an insole. A sheet of thermoplastic material formed with apertures, such as ULTRATHENE thermoplastic material, is then interposed between the female half and a male half of the mold. The male half of the mold is moved into the female half to press the thermoplastic sheet into the liquid cushioning material so that the thermoplastic sheet is embedded therein and the cushioning material flows at least partially into the apertures formed in the thermoplastic sheet. Depending upon the pressure applied between the mating mold halves, the upper surface of the thermoplastic sheet is either spaced above the upper surface of the layer of cushioning material or is flush therewith.

In an alternative method, a foamed material such as crosslinked polyethylene foam is transported in sheet form through an oven or other type of heating device so that at least the upper portion of the foam sheet becomes tacky or flowable. A sheet of thermoplastic material formed with apertures, such as ULTRATHENE thermoplastic material, is then placed atop the upper portion of the foam sheet. In one embodiment, the thermoplastic sheet and the foam sheet are transferred between the mating halves of a mold formed in the shape of an insole. Alternatively, the thermoplastic sheet and foam sheet are transmitted between a pair of mating press rollers and later formed in the shape of insoles by a cutting or stamping operation. In either embodiment, the thermoplastic sheet is at least partially embedded in the upper portion of the foam sheet so that the cushioning material of the foam sheet flows at least partially into the apertures in the thermoplastic sheet.

The insoles of this invention, made in accordance with any of the manufacturing techniques described above, can thus be formed to accommodate the requirements of a wide variety of shoes. The top, thermoplastic layer can be embedded at various depths within the upper portion of the bottom, cushioning layer so that the upper surface of the top layer is either spaced from the upper surface of the bottom layer or is substantially flush therewith. In activities where a moisture flow path and/or a thermal barrier is desirable, the insoles herein are formed such that the upper surface of the top layer is spaced above the upper surface of the bottom layer.

In activities wherein added comfort is most important, the insoles herein are formed with the top layer substantially flush with the bottom layer so that more of the cushioning material forming the bottom layer contacts the sock and foot.

Additionally, the insole of this invention controls the movement of the foot and sock within the shoe. The coefficient of friction of the upper surface of the top layer of the insole which contacts the sock is variable to permit more or less movement of the foot and sock therealong for added comfort and improved performance of the shoe depending upon the type of activity and playing surface for which the shoe is intended.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 1:
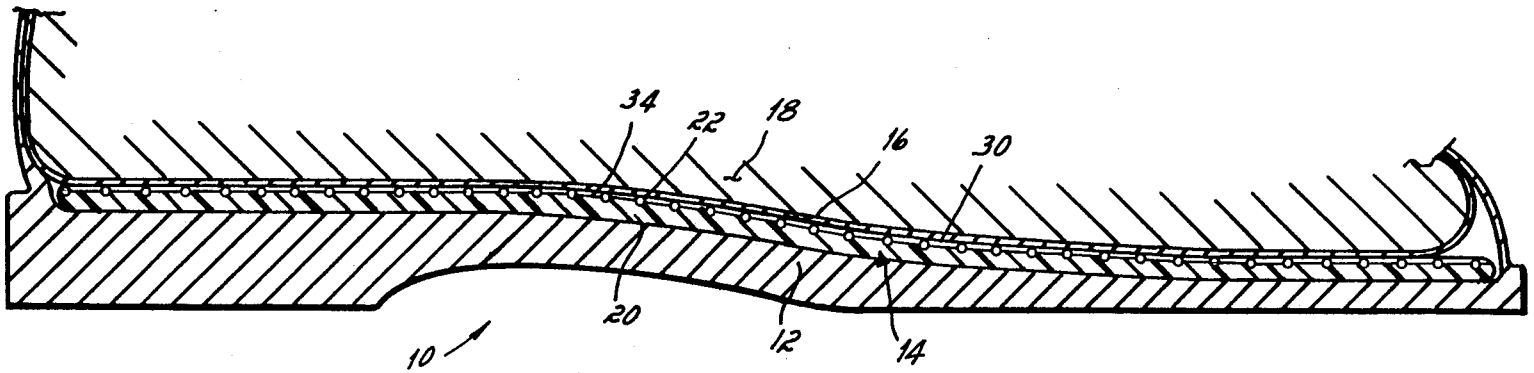
FIG. 1 is a partial cross sectional view of a shoe having the insole of this invention.
Figure 2:
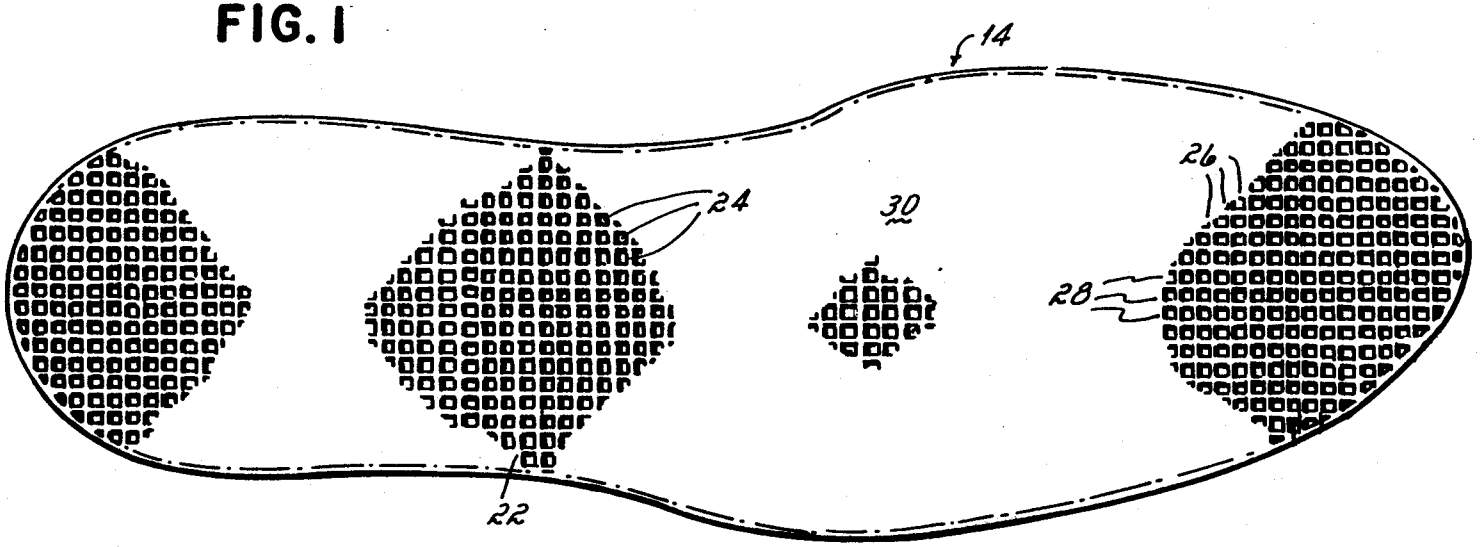
FIG. 2 is a plan view of the insole shown in FIG. 1.
Figure 5:
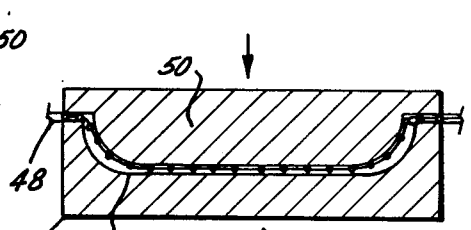
FIGS. 3–5 are schematic views of successive steps in one method of forming the insole of this invention.
Figure 4:
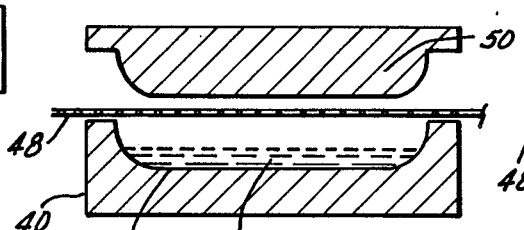
Figure 3:
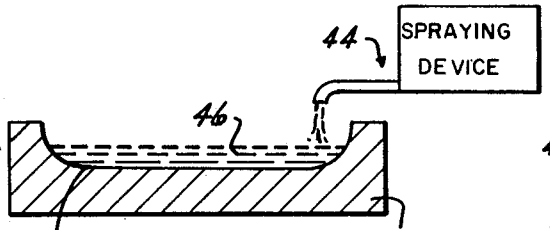

Referring now to FIGS. 1 and 2, a schematic view of a shoe 10 is illustrated having a sole 12 and an insole 14 positioned atop the sole 12, which support the sock 16 and foot 18 of the wearer. As discussed in more detail below, the insole 14 comprises a bottom layer 20 formed of a cushioning material such as urethane or polyethylene foam, and a top layer 22 formed of a non-absorbent, thermally non-conductive thermoplastic material. The top layer 22 is formed with a plurality of spaced apertures 24 arranged in columns 26 and rows 28 therealong. In one embodiment, the uppermost surface 30 of the top layer 22 is formed in an arcuate shape between the apertures 24, as shown, for example, in FIGS. 7, 10 and 11 discussed below. Alternatively, an uppermost surface 32 of the top layer 22 between the apertures 24 is substantially planar or flat in shape, as shown, for example, in FIGS. 7A, 10A and 12A.

Figure 7A:
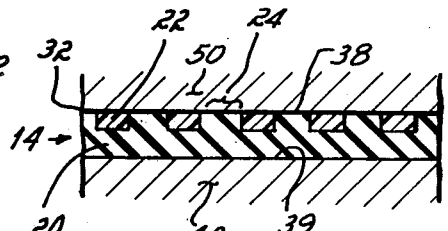
FIG. 7A is a view similar to FIG. 7 of an alternative embodiment of the top layer of the insole herein having a substantially flat upper surface.
Figure 7:
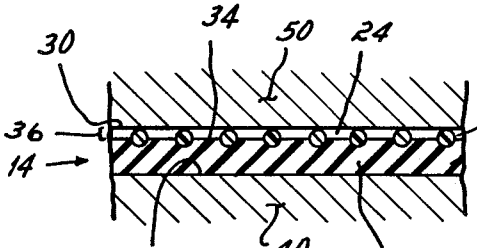
FIG. 7 is a view similar to FIG. 6 except with the cushioning material in solid form.
Figure 6:
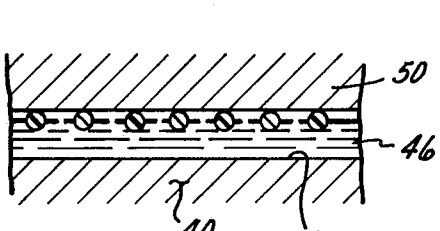
FIG. 6 is an enlarged, cross sectional view of the process step of FIG. 5 wherein the cushioning material is in a liquid form and the sheet of thermoplastic material is embedded therein.
Figure 10:
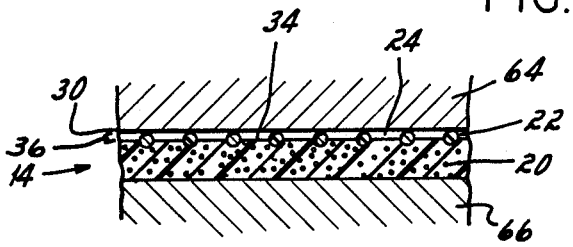
FIG. 10 is a cross sectional view of the product formed by the method of FIG. 9 employing one embodiment of the top layer of the insole herein.
Figure 10A:
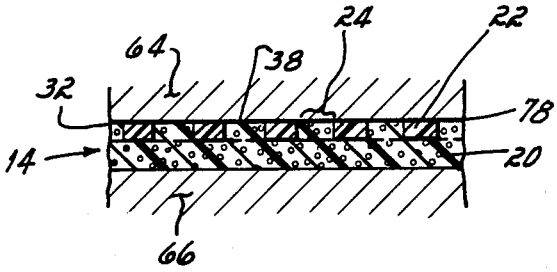
FIG. 10A is a view similar to FIG. 10 employing an alternative embodiment of the top layer of the insole herein.
Figure 12:
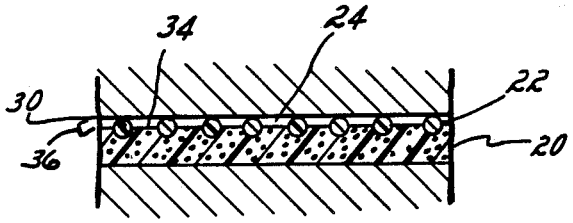
FIG. 12 is a cross sectional view taken of the product formed by the method of FIG. 11 in which one form of the top layer is employed.
Figure 12A:
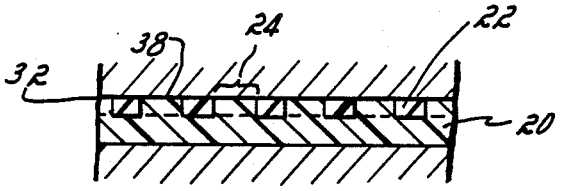
FIG. 12A is a view similar to FIG. 12 employing an alternative embodiment of the top layer herein.

Preferably, the top layer 22 of insole 14 is at least partially embedded in the upper portion of the bottom layer 20. In FIGS. 7, 10 and 12, the uppermost surface 30 of the top layer 22 is spaced from the uppermost surface 34 of the bottom layer 20 forming a space 36 therebetween. Alternatively, as shown in FIGS. 7A, 10A and 12A, the uppermost surface 32 of the top layer 22 is substantially flush with the uppermost surface 38 of the bottom layer 20. In each of these embodiments, the top layer 22 is embedded in the bottom layer 20 such that a portion of the material forming the bottom layer 20 extends at least partially into the apertures 24 of the top layer 22.

In the presently preferred embodiment, the top layer 22 of insole 14 is formed of an ethylenevinyl acetate copolymer, commercially available from U.S. Industrial Chemicals Company of Tuscola, Illinois under the registered trademark ULTRATHENE. Depending upon the type of activity and playing surface for which a particular shoe 10 is intended, the vinyl acetate content of top layer 22 can be varied to alter the coefficient of friction of its uppermost surface 30 or 32 which contacts the sock 16.

For example, in activities played on surfaces which permit substantial movement of the shoe 10 with respect to a playing surface, such as playing tennis on a clay court or soccer on grass, it is preferable to limit the movement of the foot 18 and sock 16 along the top layer 22 of insole 14. In this instance, the coefficient of friction of the uppermost surface 30 or 32 of top layer 22 should be somewhat greater than the coefficient of friction of the skin of the foot in order to provide the desired comfort and "feel" of the shoe. This is achieved in the instant invention by forming the top layer 22 with a material such as ULTRATHENE UE 646 wherein the vinyl acetate content of the material is approximately 28% by weight. This forms a top layer 22 whose uppermost surface 30 or 32 has a higher coefficient of friction than that of the skin of the foot. The sock 16 and foot 18 are thus prevented from moving to a great degree with respect to the insole 14 which adds to the comfort and performance of shoes 10 intended for such activities.

On the other hand, some types of shoes are intended for activities played on surfaces having a relatively high coefficient of friction such as the play of basketball, racquetball, squash and the like on lacquered hardwood floors. In these activities, the shoe aggressively grips the playing surface and there is a substantial amount of quick and often violent motion of the foot in the forward-rearward and lateral directions. These activities require that the foot 18 and sock 16 be permitted to move at least to some degree with respect to the insole 14 to avoid forming blisters on the foot. This movement is obtained with the insole 14 herein by forming the top layer 22 of a material having a somewhat lower coefficient of friction than that of the skin of the foot, such as ULTRATHENE UE 635. This material has a vinyl acetate content of approximately 9% by weight and produces a top layer 22 having an uppermost surface 30 or 32 with a somewhat lower coefficient of friction than that of the skin of the foot.

Still other activities in which active wear shoes are employed do not involve substantial sliding of the foot relative to a surface or violent stopping or starting motions. In activities such as walking, hiking, jogging, etc., it is preferable to form the uppermost surface 30 or 32 of top layer 22 with a coefficient of friction which permits the foot 18 and sock 16 to move to a greater extent atop the insole 14 than is required where the shoes readily slide on the playing surface, but less than that required for the play of sports such as basketball on hardwood floors. In these applications, the top layer 22 of insole 14 has an uppermost surface 30 or 32 which is formed with a coefficient of friction approximately equal to that of the skin of the foot. This has been found to avoid problems of blistering of the foot which can be created where the sock 16 is gripped too tightly within the shoe, and also problems of injury to the toes caused by impact of the foot with the front of the shoe where the sock and foot are allowed to readily slip relative to the insole. In order to provide such a coefficient of friction, the top layer 22 herein is preferably formed of a material such as ULTRATHENE UE 652 having a vinyl acetate content of approximately 19% by weight.

Referring now to FIGS. 3–7A, one method of manufacturing the insole 14 of this invention is schematically illustrated. Initially, the cavity 39 of a female half 40 of a mold 42 having the shape of an insole is filled by a spraying device 44 with a cushioning material 46 in liquid form. It is contemplated that the cushioning material 46 can be any suitable type of commercially available urethane material such as the cellular urethane sold under the federally registered mark PORON owned by Rogers Corporation of East Woodstock, Conn.

Once the liquid cushioning material 46 is in place in the female half 40 of mold 42, a sheet 48 of thermoplastic material formed with apertures 24, such as the ULTRATHENE material discussed above, is interposed between the female half 40 and a male half 50 of the mold 42. The male half 50 of the mold 42 is then moved into engagement with the female half 40 to embed the thermoplastic sheet 48 into the liquid cushioning material 46. See FIGS. 5 and 6.

As shown in FIGS. 7 and 7A, when the liquid cushioning material 46 has cured, it forms the bottom layer 20 of the insole 14 and the sheet 48 forms the top layer 22 thereof. In one embodiment, the top layer 22 is embedded within the bottom layer 20 such that the uppermost surface 30 of top layer 22, which is arcuate in shape between adjacent apertures 24, is spaced from the uppermost surface 38 of bottom layer 20 forming a gap 36 therebetween for channeling moisture away from the foot 18 and/or to form a thermal barrier between the shoe sole 12 and foot 18. In addition, at least a portion of the cushioning material 46 forming the bottom layer 20 extends into the apertures 24 of the top layer 22 in the course of embedding the sheet 48 into the liquid cushioning material 46. See FIG. 7.

In the alternative embodiment shown in FIG. 7A, the uppermost surface 32 of top layer 22 is essentially flat or planar. In this embodiment, the pressure applied between the male half 50 and female half 40 of the mold 42 is such that the uppermost surface 32 of top layer 22 is positioned substantially flush with the uppermost surface 38 of bottom layer 20. The cushioning material 46 is thus made to flow through the entire depth of the apertures 24 in top layer 22 during the forming operation. It is contemplated that insoles 14 such as shown in FIG. 7A would be particularly useful in activities wherein a high degree of comfort is required, and thus a relatively large surface area of cushioning material 46 forming the bottom layer 20 is presented at the top of the insole 14 for contact with the foot 18.

Figure 8:
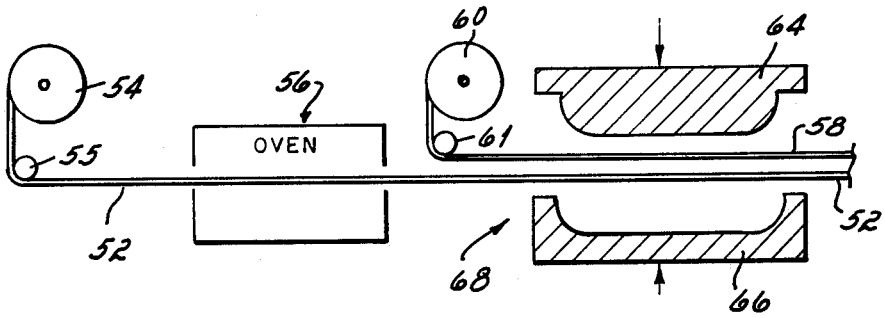
FIGS. 8 and 9 are schematic views of successive steps of an alternative method of manufacturing the insole of this invention.
Figure 9:
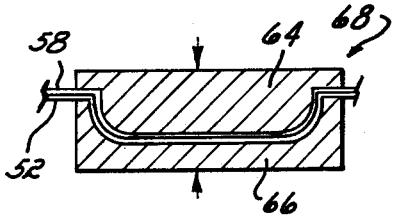

Referring now to FIGS. 8 and 9, an alternative method of forming an insole 14 according to this invention is illustrated. This method is a thermal forming operation particularly intended for use with conventional foam materials employed in the formation of insoles such as crosslinked polyethylene foam.

As shown in FIG. 8, a sheet 52 of foam material is transmitted from a roll 54, around a guide roller 55 and then through an oven 56 or other suitable heating device. A sheet 58 of apertured thermoplastic material, such as the ULTRATHENE material, described above, is fed from a roll 60 around a guide roller 61 and then on or immediately above the foam sheet 52. The two sheets 52, 58 are then passed between the male half 64 and female half 66 of a mold 68 which is operated to form the sheets 52, 58 in the shape of an insole 14. See FIG. 9.

In the course of passage through the oven 56, the upper portion of the foam sheet 52 is heated to a tacky or flowable state. When the male and female halves 64, 66 of the mold 68 are subsequently brought together, the apertured, thermoplastic sheet 58 is embedded into the upper portion of the foam sheet 52 as shown in FIGS. 10 and 10A forming the top layer 22 and bottom layer 20 of insole 14. In FIG. 10, the uppermost surface 30 of top layer 22 has an arcuate shape between adjacent apertures 24, and this uppermost surface 30 is spaced above the uppermost surface 38 of the bottom layer 20 forming a gap 36 therebetween. Alternatively, as shown in FIG. 10A, the uppermost surface 32 of top layer 22 between adjacent apertures has a substantially planar or flat uppermost surface 32. In this embodiment, the male and female mold halves 64, 66 are operated to embed the thermoplastic sheet 58 within the foam sheet 52 so that the resulting top layer 22 of insole 14 has its uppermost surface 32 flush with the uppermost surface 38 of bottom layer 20.

Figure 11:
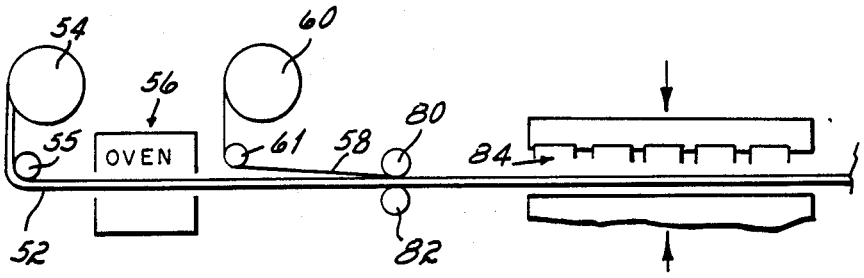
FIG. 11 is a schematic view of still another alternative method of forming the insole of this invention.

A still further apparatus for the manufacture of insoles 14 is illustrated in FIG. 11. This apparatus is similar to that shown in FIG. 8, except in two respects, and structure common to both embodiments is given the same reference numbers. The insole mold 68 is eliminated in the apparatus of FIG. 11 and replaced with a pair of press rollers 80, 82, and insole cutters or stamps 84 are provided to form the thermoplastic material and foam material in the shape of an insole 14.

Figure 13:
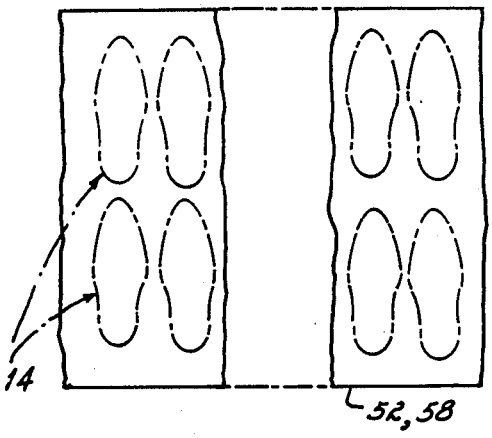
FIG. 13 is a plan view of a sheet of material formed by the process of FIG. 11 with the insoles to be cut therefrom shown in phantom.

In the embodiment of FIG. 11, the foam sheet 52 is passed through oven 56, a thermoplastic sheet 58 is placed atop the foam sheet 52 and then the sheets 52, 58 are transmitted through the press rollers 80, 82 which embed the thermoplastic sheet 58 into the upper portion of the foam sheet 52. The resulting product, shown in FIGS. 12 and 12A, is identical to that formed with the apparatus of FIG. 8 except it has not yet been formed in the shape of an insole. The insole forming operation is performed by a series of insole stamps 84, located downstream from the press rollers 80, 82, which cut out the insoles 14 as shown in phantom in FIG. 13.

While the invention has been described with reference to a preferred embodiment, it will be understood by those skilled in the art that various changes may be made and equivalents may be substituted for elements thereof without departing from the scope of the invention. In addition, many modifications may be made to adopt a particular situation or material to the teachings of the invention without departing from the essential scope thereof.

For example, the relative spacing of the apertures 24 formed in the top layer 22 illustrated in FIG. 2, and their shape, is not critical. For example, it is contemplated that the apertures 24 could be of essentially any configuration, e.g., triangular, hexagonal, octagonal, etc., without departing from the scope of the invention. Additionally, the dimensions of the apertures 24 is not critical although it is contemplated that there should be at least about 10 apertures 24 per square inch of surface area of the top layer 22.

The configuration of the uppermost surface of top layer 22 between adjacent apertures 24 is shown as either arcuate or flat in the Figs. When the uppermost surface of the top layer 22 is shown spaced above the bottom layer 20, the top layer 22 has an arcuate shape between adjacent apertures 24. On the other hand, the uppermost surface of top layer 22 is shown as being flat between adjacent apertures 24 when such surface is flush with the uppermost surface of the bottom layer 20. It is contemplated, however, that this could be reversed, i.e., the uppermost surface of top layer 22, regardless of its configuration, could be either spaced above or flush with the uppermost surfaces of the bottom layer 20.

In addition, the method depicted in FIGS. 8 and 11 show the thermoplastic sheet 58 applied onto the foam sheet 52 after the heating operation. It is contemplated, however, that the two sheets 52, 58 could be connected together prior to the heating step and thereafter pressed together.

Therefore, it is intended that the invention not be limited to the particular embodiment disclosed as the best mode contemplated for carrying out this invention, but the invention will include all embodiments falling within the scope of the appended claims.

I claim:

1. An insole for a shoe, comprising:

a bottom layer formed of a cushioning material, said bottom layer having an upper surface and a lower surface adapted to overlie the sole of a shoe;

a top layer formed with a plurality of apertures, said top layer having an upper surface and a lower surface;

said upper surface of said top layer being adapted to contact a foot and sock when the insole is inserted in a shoe, said upper surface of said top layer having frictional characteristics which control movement of the foot and sock with respect to said top layer within the shoe;

said top layer being at least partially embedded in said bottom layer so that said lower surface of said top layer extends beneath said upper surface of said bottom layer and said cushioning material of said bottom layer extends at least partially into said apertures in said top layer.

2. The insole of claim 1 in which said top layer is a non-absorbent, thermally non-conductive section of ethylene-vinyl acetate copolymer.

3. The insole of claim 1 in which said upper surface of said top layer is spaced from said upper surface of said bottom layer to permit the passage of air and moisture from a foot and sock resting atop said top layer to said bottom layer of said insole.

4. The insole of claim 1 in which said upper surface of said top layer is flush with said upper surface of said bottom layer.

5. An insole for a shoe, comprising:

a bottom layer formed of a cushioning material, said bottom layer having an upper surface and a lower surface adapted to overlie the sole of a shoe;

a top layer formed with a plurality of apertures, said top layer having an upper surface and a lower surface;

said top layer being at least partially embedded in said bottom layer so that said lower surface of said top layer extends beneath said upper surface of said bottom layer and said cushioning material of said bottom layer extends at least partially into said apertures in said top layer;

said upper surface of said top layer having a coefficient of friction approximately equal to the coefficient of friction of the skin of the foot so as to control the movement of the foot and sock within the shoe.

6. The insole of claim 5 in which said top layer is a non-absorbent, thermally non-conductive section of ethylene-vinyl acetate copolymer having a vinyl acetate content of about 19% by weight.

7. An insole for a shoe intended for use in activities played on surfaces wherein the shoe is permitted to readily slide relative to the playing surface, comprising:

a bottom layer formed of a cushioning material, said bottom layer having an upper surface and a lower surface adapted to overlie the sole of a shoe;

a top layer formed with a plurality of apertures, said top layer having an upper surface and a lower surface;

said top layer being at least partially embedded in said bottom layer so that said lower surface of said top layer extends beneath said upper surface of said bottom layer and said cushioning material of said bottom layer extends at least partially into said apertures in said top layer;

said upper surface of said top layer having a coefficient of friction greater than the coefficient of friction of the skin of the foot so as to permit limited movement of the foot and sock within the shoe during the play of such activities as tennis on a clay surface and soccer on a grass surface.

8. The insole of claim 7 in which said top layer is a non-absorbent, thermally non-conductive section of ethylene-vinyl acetate copolymer having a vinyl acetate content of about 28% by weight.

9. An insole for a shoe intended for use in activities played on surfaces wherein the shoe is permitted to move to a limited extent relative to the playing surface, comprising:

a bottom layer formed of a cushioning material, said bottom layer having an upper surface and a lower surface adapted to overlie the sole of a shoe;

a top layer formed with a plurality of apertures, said top layer having an upper surface and a lower surface;

said top layer being at least partially embedded in said bottom layer so that said lower surface of said top layer extends beneath said upper surface of said bottom layer and said cushioning material of said bottom layer extends at least partially into said apertures of said top layer;

said upper surface of said top layer having a coefficient of friction less than the coefficient of friction of the skin of the foot so as to permit movement of the foot and sock within the shoe during the play of such activities as basketball, racquetball, squash and aerobics on such surfaces as a lacquered or varnished hardwood floor.

10. The insole of claim 9 in which said top layer is a non-absorbent, thermally non-conductive section of ethylene-vinyl acetate copolymer having a vinyl acetate content of about 9% by weight.

* * * * *